US007008291B2

(12) United States Patent
Bruder

(10) Patent No.: US 7,008,291 B2
(45) Date of Patent: Mar. 7, 2006

(54) TOY VEHICLE, IN PARTICULAR TRACTOR, WITH AT LEAST TWO STEERABLE WHEELS

(75) Inventor: Paul Heinz Bruder, Furth (DE)

(73) Assignee: BRUDER Spielwaren GmbH & Co. KG, Fürth-Burgfarmback (DE)

( * ) Notice: Subject to any disclaimer, the term of this patent is extended or adjusted under 35 U.S.C. 154(b) by 108 days.

(21) Appl. No.: 10/851,067

(22) Filed: May 24, 2004

(65) Prior Publication Data

US 2005/0176344 A1 Aug. 11, 2005

(30) Foreign Application Priority Data

Feb. 10, 2004 (DE) ..... 20 2004 001 973 U

(51) Int. Cl.
*A63H 17/36* (2006.01)

(52) U.S. Cl. ..... 446/460; 446/448; 446/452

(58) Field of Classification Search ..... 446/427, 446/434, 448, 450, 452, 465, 468, 460, 451, 446/437; 280/771, 775; 180/183
See application file for complete search history.

(56) References Cited

U.S. PATENT DOCUMENTS 4,441,735 A * 4/1984 Hutchison et al. ..... 280/771
4,595,380 A * 6/1986 Magers ..... 446/451
6,272,946 B1 * 8/2001 Roux ..... 74/498

FOREIGN PATENT DOCUMENTS

DE 298 01 781 U1 5/1998
EP 935989 A1 * 8/1999
GB 2187108 A * 9/1987

* cited by examiner

*Primary Examiner*—Bena Miller
(74) *Attorney, Agent, or Firm*—Browdy and Neimark, PLLC

(57) ABSTRACT

In a toy vehicle, in particular tractor, comprising at least two steerable wheels, with a pivoting motion of a steering wheel being converted via a steering gear into a pivoting motion of a bolster, with wheels being mounted on steering knuckles that are pivotably mounted on a front axle, and with the pivoting motion that is occasioned by a steering job pivoting steering pivot pins and thus the wheels via a track rod and via steering drop arms, it is provided, with a view to accomplishing the extreme wheel turning found in full size tractors also in a toy vehicle, mechanical conversion being put into practice in as simple and functionally safe a way and at as low a cost as possible, that the front axle is connected to a first end of the bolster; that the steering gear is formed on a second end of the bolster; that the bolster, between the first and the second end, comprises a pivot bearing for a pivoting motion relative to the chassis to be obtained; and that the track rod centrally comprises a pivot bearing which is stationary relative to the chassis.

7 Claims, 5 Drawing Sheets

TOY VEHICLE, IN PARTICULAR TRACTOR, WITH AT LEAST TWO STEERABLE WHEELS

BACKGROUND OF THE INVENTION

1. Field of the Invention

The invention relates to a toy vehicle, in particular in the form of a tractor, comprising at least two steerable wheels, with the pivoting motion of a steering wheel being converted via a steering gear into a pivoting motion of a bolster, with the wheels being mounted on steering knuckles that are pivotably mounted on the front axle, with the pivoting motion that is occasioned by a steering job pivoting the steering pivot pins and thus the wheels via a track rod and via steering drop arms.

2. Background Art

A toy vehicle of the generic type is known from DE 298 01 781 U1.

Tractor steering systems are known in rural engineering, enabling extreme turning of the wheels to be put into practice by hydraulic gears, which implies considerable technical requirements whereby to achieve excellent maneuverability.

SUMMARY OF THE INVENTION

It is an object of the invention, proceeding from that full size tractor technology, to accomplish such extreme wheel turning also in a toy vehicle, mechanical conversion being desired to be put into practice in as simple and functionally safe as way and at as low a cost as possible.

According to the invention, this object is attained in that the front axle, by one end, is connected to a first end of the bolster; in that the steering gear is formed on the second end of the bolster; in that the bolster, between the first and the second end, comprises a pivot bearing for a pivoting motion relative to the chassis to be obtained; and in that the track rod centrally comprises a pivot bearing that is stationary relative to the chassis.

As a result of this design, the front axle, and thus also the wheels mounted thereon, are pivoted in their entirety upon actuation of the steering wheel, with a pivoting motion of the individual wheels relative to the front axle superimposing this steering motion. This is accomplished in that the front axle, when pivoted, is displaced in parallel to the track rod due to the fact that the pivot bearing of the track rod is connected to the chassis so that the steering drop arms, which are pivotably joined to the ends of the track rod, deflect the wheels.

In keeping with another embodiment of the invention, it is provided that the front axle in its entirety is mounted pendulously about a horizontal pivot axis, it being possible for instance to cross obstacles without the entire vehicle being tilted.

The steering gear preferably comprises a gear wheel on the bottom end of the steering column that is joined to the steering wheel, and an arcuate toothed segment provided on the bolster.

In this regard, the bolster can be provided with a recess, on the inside of which the toothed segment is provided and with which the gear wheel of the steering column engages.

By advantage, the pivot bearing for the bolster is formed by a journal on the chassis which engages with a corresponding bearing recess of the bolster.

The track-rod pivot bearing too can be formed by a journal on the chassis engaging with a corresponding recess of the track rod.

Details of the invention will become apparent from the ensuing description of a preferred embodiment, taken in conjunction with the drawing.

DESCRIPTION OF A PREFERRED EMBODIMENT

Figure 1:
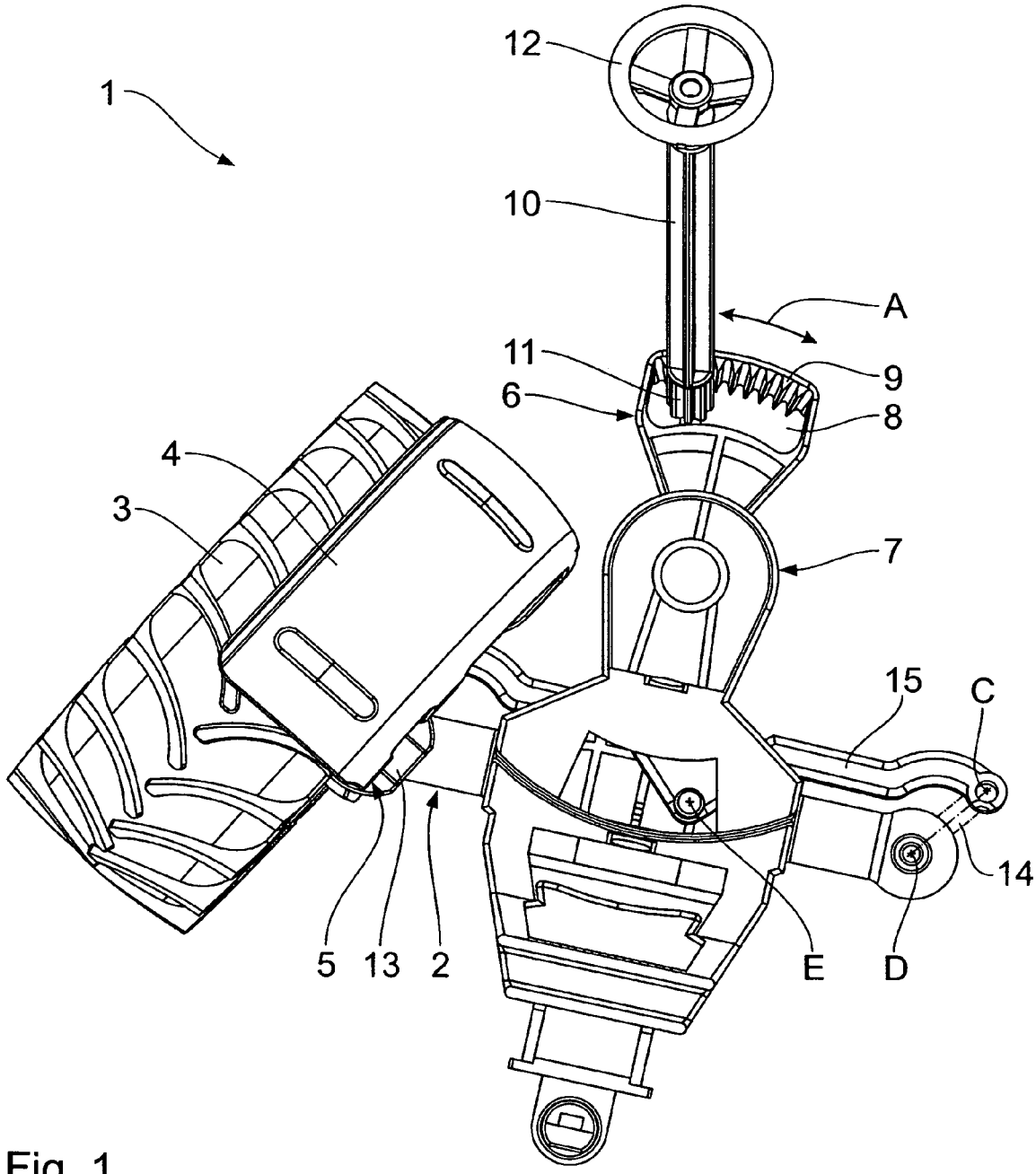
FIG. 1 is a plan view of the substantial parts of the steering system of a toy vehicle according to the invention.
Figure 2:
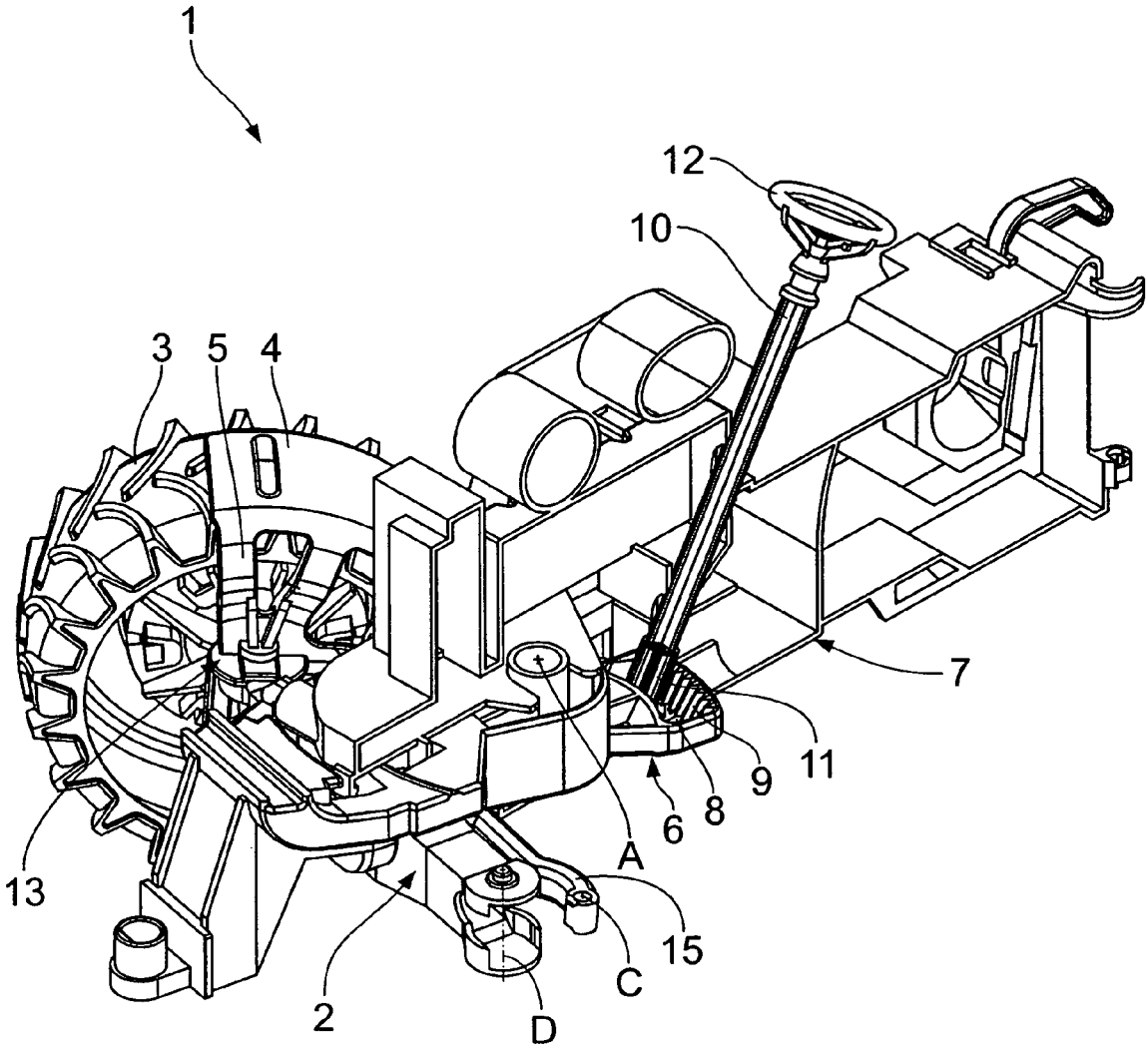
FIG. 2 is a perspective view of the right half of the chassis and the left half of the steering system seen in the direction of travel.

A toy vehicle 1 seen in the drawing comprises a steerable front axle 2 with two wheels 3, each of which is covered by a mudguard 4 that is connected to the front axle 2 by way of braces 5.

The front axle 2 is mounted on a bolster 6 which is mounted on the chassis 7 pivotably about a pivot bearing A.

On the rear end of the bolster 6, provision is made for a recess 8, the rear inside of which is provided with a toothed segment 9 of a configuration in the shape of a segment of a circle. Depending on the desired turning direction, the toothed segment might just as well be disposed on the outside. In the case of remote radio control, actuation might be effected via another mechanism by way of a steering gear. The bottom end of a steering column 10 engages with the recess 8; it is designed as a gear wheel 11 for engagement with the toothed segment 9. The top end of the steering column 10 is provided with a steering wheel 12. Actuation of the steering wheel i.e., its being pivoted, sets the gear wheel 11 interacting with the toothed segment 9 so that the bolster 6 can be pivoted about the pivot bearing A, whereby the wheels 3 are pivoted with the object of a turning motion.

The wheels 3 are mounted on steering knuckles 13 by way of wheel bearings F which are pivotable about a vertical pivot axis D.

Steering drop arms 14 engage with the steering knuckles 13; they are coupled via a pivot bearing C with a track rod 15 which is parallel to the front axle 2 and pivotable about a stationary pivot bearing E that is formed on the chassis 7.

Figure 4:
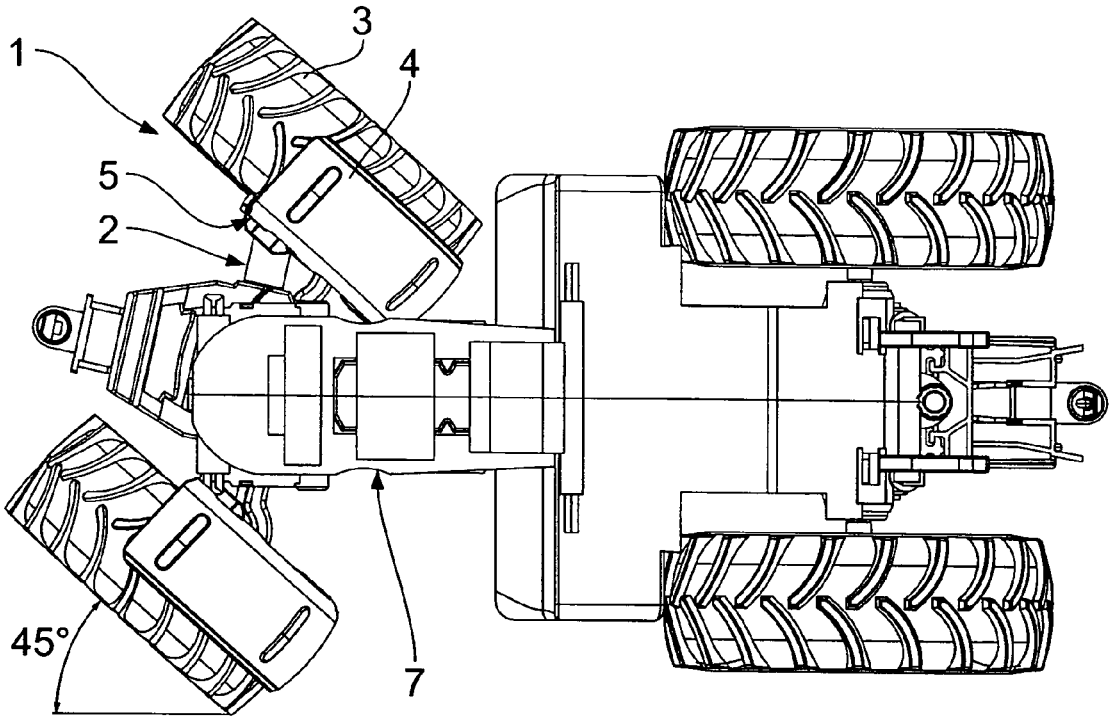
FIGS. 4 to 6 are plan views of a toy vehicle according to the invention, showing a maximum turn to the right, straight travel, and a maximum turn to the left.
Figure 5:
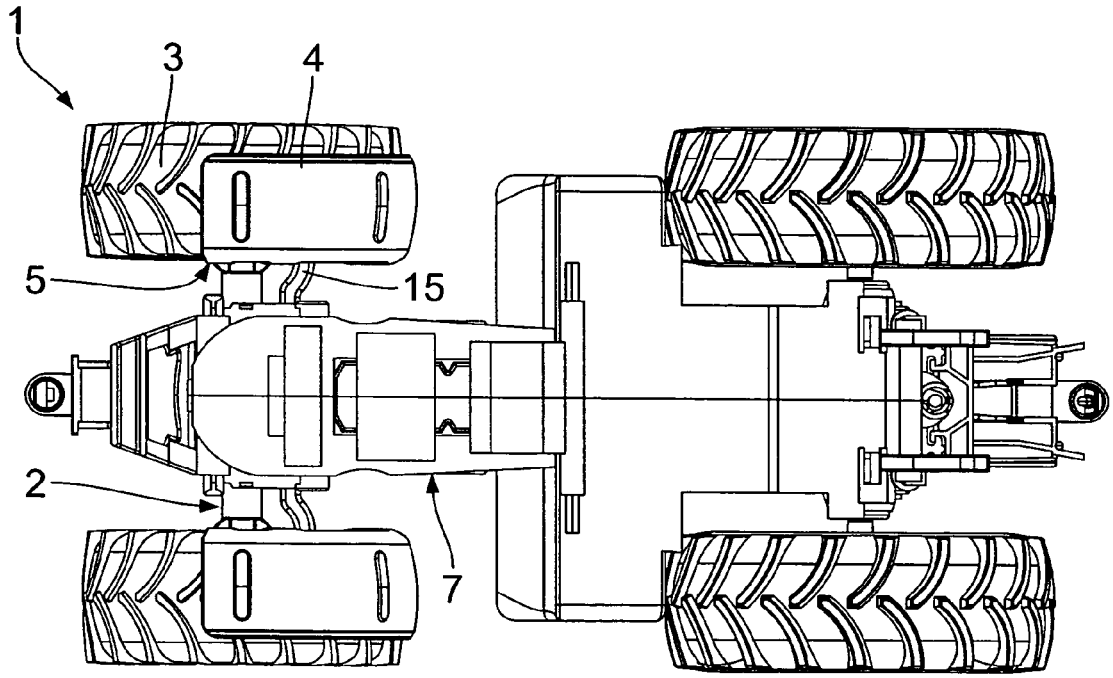
Figure 6:
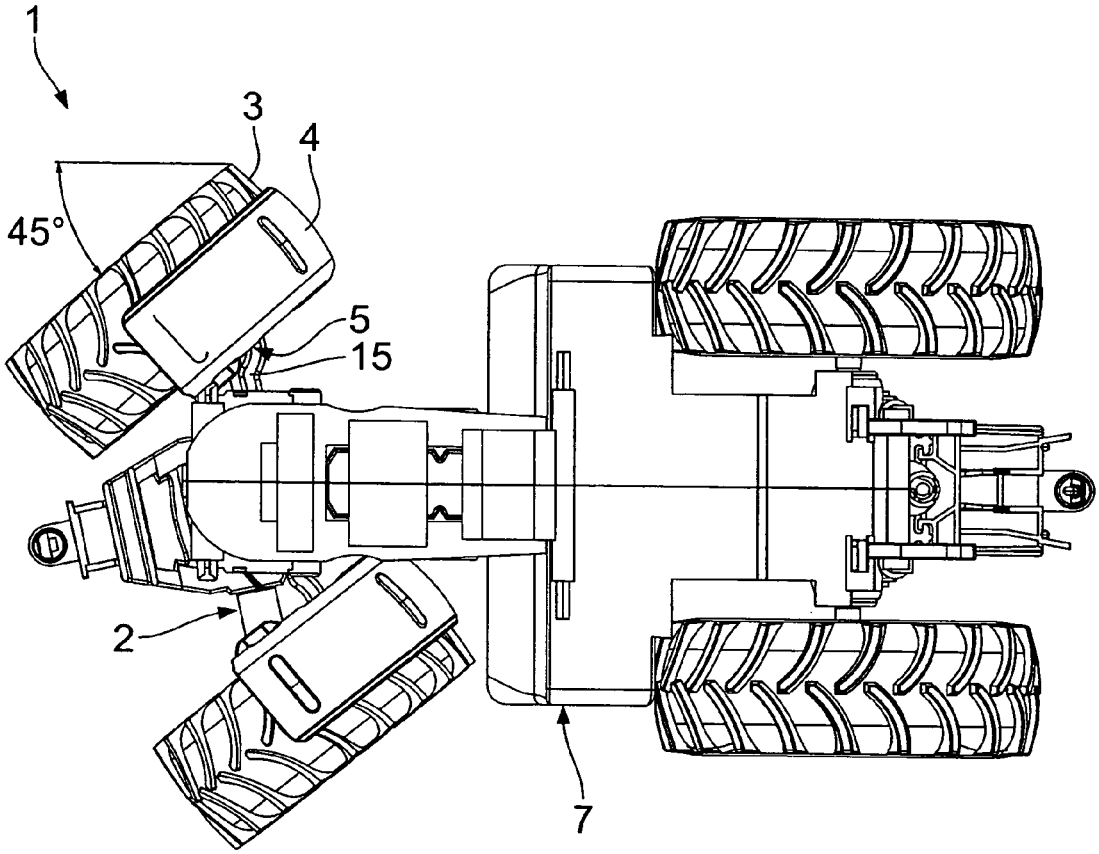

This design results in that, when the front axle 2 is pivoted upon actuation of the steering wheel 12, the front axle experiences some displacement parallel to the track rod 15 that is stationarily pivotably mounted so that, by way of the pivot bearings C, the steering drop arms 14, by superimposition of the pivoting motion of the front axle, are deflected in the direction of the pivoting motion thereof, with the turning effect on the wheels 3 being increased once again as compared to the pivoting motion of the front axle 2, it being possible in this way to attain an overall turn of up to 45° in the direction of travel to the left and the right as seen in FIGS. 4 and 6.

Figure 3:
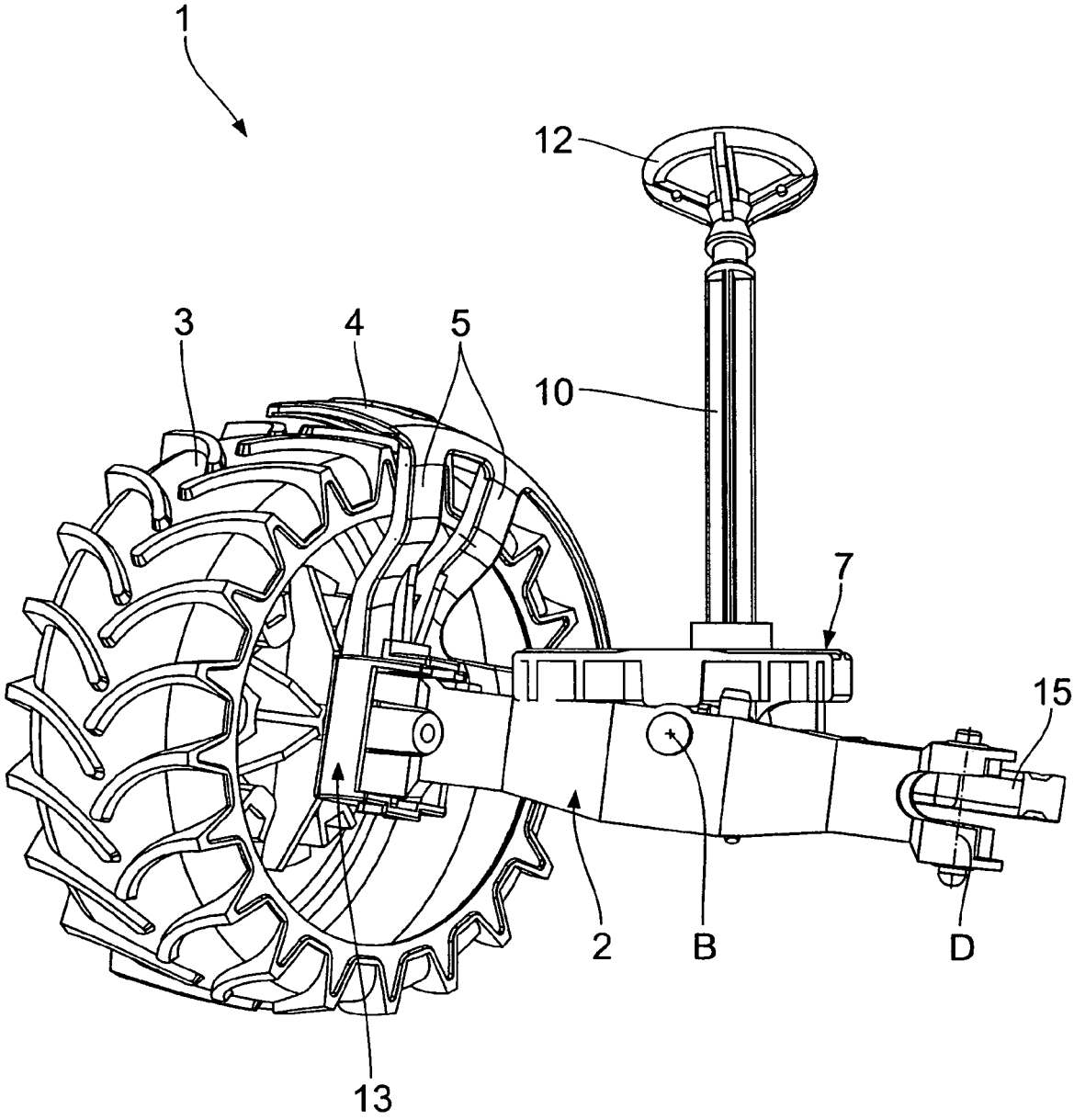
FIG. 3 is a perspective view of the steering system inclusive of the mudguards.

FIG. 3 shows that the front axle 2 is suspended pendulously about the longitudinal axis of the vehicle by means of the bearing B so that ground contact of all the wheels is ensured regardless of the surface of the ground. The suspension is such that deflection of the track rod 15 is possible at any pendular angle of the front axle. This is achieved by the pivot bearing B of the front axle being constructionally favorably arranged in relation to pivot points of the track rod within the chassis.

What is claimed is:

1. A toy vehicle comprising, a chassis (7);

a bolster (6) rotatably mounted on a vertical pivot bearing A on the chassis (7);

a front axle (2) having steering knuckles (13) respectively fixed on opposite ends thereof; the front axle being fixed to a first end of the bolster (6);

a vertical wheel bearing F rotatably engaged in each of the steering knuckles (3);

a steering gear formed on a second end of the bolster (6);

a steering wheel (12) engaged on the chassis (7) rotatably engaged to the steering gear;

a track rod (15) rotatable at a center thereof around a pivot bearing E fixed on chassis (7); and ends of the track rod (15) respectively and rotatably engaged to a steering drop arm (14), the steering drop arm being fixed to the vertical wheel bearing F;

wherein when the steering wheel (12) is turned the wheels (13) are steered along with rotation of the bolster (6) and the track rod (15) is rotated to further steer wheels (13) beyond that due to rotation of the bolster (6) alone.

2. The toy vehicle according to claim 1, wherein the vehicle is a tractor.

3. The toy vehicle according to claim 1, wherein the front axle (2) in its entirety is mounted pendulously about a horizontal pivot axis B.

4. The toy vehicle according to claim 1, wherein the steering gear comprises a gear wheel (11) on a bottom end of a steering column 10 that is connected to the steering wheel (12), and an arcuate toothed segment (9) on the bolster (6).

5. The toy vehicle according to claim 4, wherein the bolster (6) comprises a recess (8), on an inside of which the toothed segment (9) is formed, and with which engages the gear wheel (11) of the steering column (10).

6. The toy vehicle according to claim 1, wherein the pivot bearing A for the bolster (6) is constituted by a journal on the chassis (7) which engages with a corresponding bearing recess of the bolster (6).

7. The toy vehicle according to claim 1, wherein the pivot bearing E for the track rod (15) is constituted by a journal on the chassis (7) which engages with a corresponding recess of the track rod (15).

* * * * *